US005926083A

United States Patent [19]

Asaoka

[11] Patent Number: 5,926,083

[45] Date of Patent: Jul. 20, 1999

[54] STATIC MAGNET DYNAMO FOR GENERATING ELECTROMOTIVE FORCE BASED ON CHANGING FLUX DENSITY OF AN OPEN MAGNETIC PATH

[76] Inventor: Keiichiro Asaoka, 8-8, Izumi-Cho, Atsugi-City, Kanagawa, Japan

[21] Appl. No.: 09/021,169

[22] Filed: Feb. 10, 1998

[30] Foreign Application Priority Data

Feb. 10, 1997 [JP] Japan ..... 9-026457

[51] Int. Cl.[6] ..... H01F 21/00; H01F 21/08

[52] U.S. Cl. ..... 336/110; 336/160; 336/165; 336/178

[58] Field of Search ..... 336/110, 160, 336/155, 165, 178; 310/181

[56] References Cited

U.S. PATENT DOCUMENTS

| | | | |
|---|---|---|---|
| 4,020,433 | 4/1977 | Uchidoi et al. | 335/230 |
| 4,031,457 | 6/1977 | Oberbeck | 336/110 |
| 4,122,385 | 10/1978 | Oberbeck | 336/110 |
| 4,989,574 | 2/1991 | Abe | 336/110 |

FOREIGN PATENT DOCUMENTS

| | | | |
|---|---|---|---|
| EU 3938-577 | 5/1991 | Germany | 336/110 |

OTHER PUBLICATIONS

Joshi, New magnetic device, Journal of the Institude of Engineers (India), Electronics and Telecommunication Engineering Division vol. 56, Apr. 1976.

*Primary Examiner*—Michael L. Gellner
*Assistant Examiner*—Anh Mai
*Attorney, Agent, or Firm*—Oblon, Spivak, McClelland, Maier & Neustadt, P.C.

[57] ABSTRACT

A static magnet dynamo including at least one permanent magnet having different poles; a first core comprising a soft magnetic material and which couples the different poles of the permanent magnet to form a closed magnetic path therein; a second core comprising a soft magnetic material which couples to the closed magnetic path via a paramagnetic material to form an open magnetic path; a magnetized coil wound around a portion of the first core where the closed magnetic path is formed; and an induction coil wound around a portion of the second core. A direction of a flux of the closed magnetic path is changed by applying an alternating voltage to the magnetized coil, generating an electromotive force in the induction coil by electromagnetic induction due changes in a flux of the open magnetic path induced by the change in direction of the flux of the closed magnetic path.

3 Claims, 6 Drawing Sheets

STATIC MAGNET DYNAMO FOR GENERATING ELECTROMOTIVE FORCE BASED ON CHANGING FLUX DENSITY OF AN OPEN MAGNETIC PATH

BACKGROUND OF THE INVENTION

1. Field of the Invention

This invention relates to a dynamo that generates electromotive force by electromagnetic induction by changing the flux passing through an induction coil. More particularly, this invention relates to a static magnet dynamo that changes magnets that pass through an induction coil without turning the armature or electromagnet.

2. Discussion of Background

Dynamos currently in practical use are so designed as to generate electromotive force by electromagnetic induction by changing the flux passing through an induction coil. Dynamos that generate power this way come in a wide variety, ranging from large models used in hydroelectric, thermal or atomic power plants to small models such as small dynamos with a diesel engine.

In all dynamo models mentioned above, the armature and electromagnet are turned, to change the flux passing through the induction coil, thus generating electromotive force in the induction coil by electromagnetic induction. For examples, the armature and electromagnet are turned by the torque of a water turbine in hydroelectric power generation, by the torque of the steam turbine in thermal and atomic power generation, and by the torque of the diesel engine in small dynamos.

Disadvantages

Dynamos that generate electromotive force by electromagnetic induction as mentioned above are so designed that, regardless of the size of the dynamo, the armature and electromagnet are turned in order to change the flux passing the induction coil. These dynamos are disadvantageous in that the said turning of the armature and electromagnet generates vibrations and noises.

SUMMARY OF THE INVENTION

Objects of the Invention

The purpose of this invention is to provide a static magnet dynamo devoid of any torque-giving means or other moving part to eliminate vibrations and noises, in order to resolve the various problems mentioned above.

Means of Problem-solving

To resolve the above problems, this invention is composed as described below.

The static magnet dynamo involved in this invention consists of at least one permanent magnet, a first core consisting of a soft magnetic material forming a closed magnetic path by coupling the different poles of the said permanent magnet, a second core consisting of a soft magnetic material forming an open magnetic path by being coupled to the said closed magnetic path via a paramagnetic material, a magnetized coil wound around a part consisting of only the closed magnetic path of the said first core, and an induction coil wound around the said second core. The point of this invention is to generate electromotive force in the said induction coil by electromagnetic induction by changing the direction of the flux of the said closed magnetic path by applying an alternating voltage to the said magnetized coil and by changing the flux of the said open magnetic path induced by changes in the direction of the flux in the said closed magnetic path.

The static magnet dynamo involved in this invention consists of at least one permanent magnet, a first core consisting of a soft magnetic material forming a closed magnetic path by coupling the different poles of the said permanent magnet, a second core consisting of a soft magnetic material forming a bypass closed magnetic path coupled and arranged with the first core in such a manner as to include the permanent magnet of the said closed magnetic path, a magnetized coil wound around the part consisting only of the closed magnetic path of the said first core, and an induction coil wound around the part consisting only of the closed magnetic path of the said second core. The aim of this invention is to generate electromotive force in the said induction coil by electromagnetic induction by changing the direction of the flux of the said closed magnetic path by applying an alternating current to the said magnetized coil, and by changing the flux of the said bypass closed magnetic pat,h induced by changes in the direction of the flux of the said closed magnetic path.

Effects

In the above configuration, the static magnet dynamo involved in this invention consists of a first core consisting of a permanent magnet and a closed magnetic path, a second core consisting of an open magnetic path via a paramagnetic material, a magnetized coil wound around the part consisting only of the closed magnetic path of the first core, and an induction coil wound around the second magnetic path. The said dynamo is so designed as to generate electromotive force in the induction coil by electromagnetic force by changing the direction of the flux of the first core by applying an alternating voltage to the magnetized coil, and by changing the flux of the second core induced by changes in the direction of the flux of the first core.

This makes it possible to change the flux passing through the induction coil without a torque-giving means or other moving part and to generate electromotive force in the induction coil by electromagnetic induction, thus enabling power generation without causing vibrations or noises. This dynamo can also be downsized and made available at low prices.

Other characteristics and benefits of this invention will be made clear by the description given below with diagrams attached.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
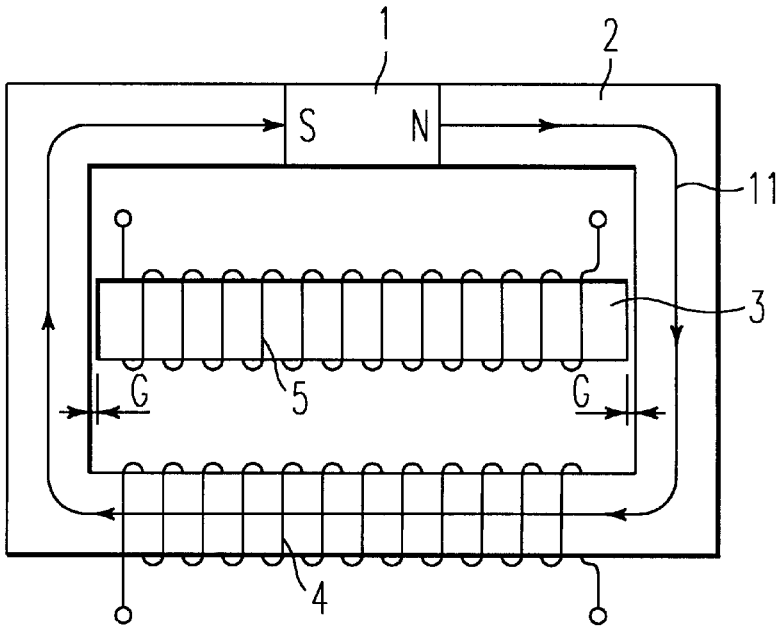
FIG. 1 represents a basic configuration of a static magnet dynamo with an open magnetic path involved in this invention.
Figure 2:
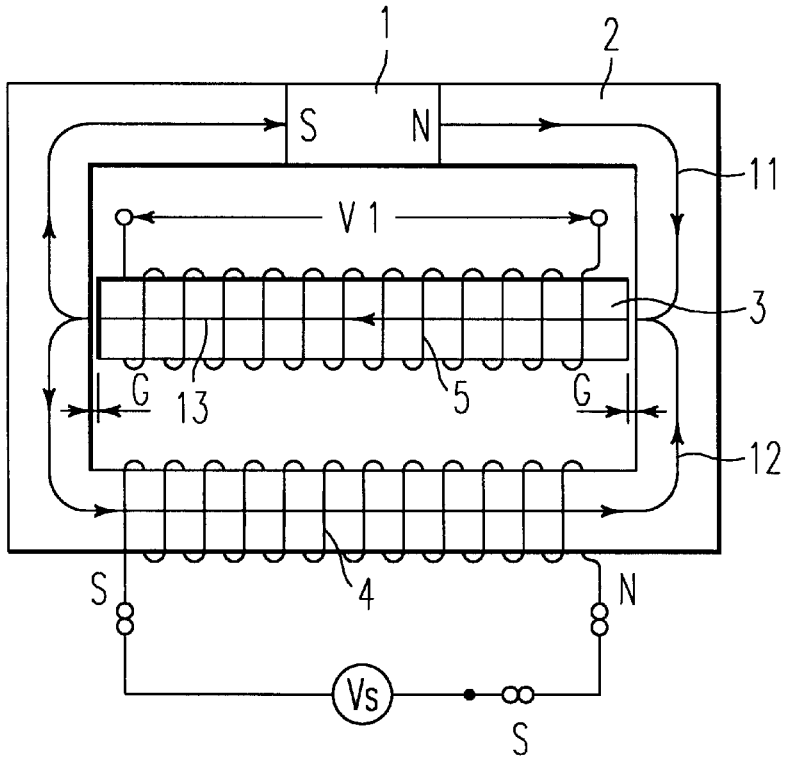
FIG. 2 represents how a flux in the direction opposed to that of a permanent magnet typically occurs in the magnetized coil.
Figure 3:
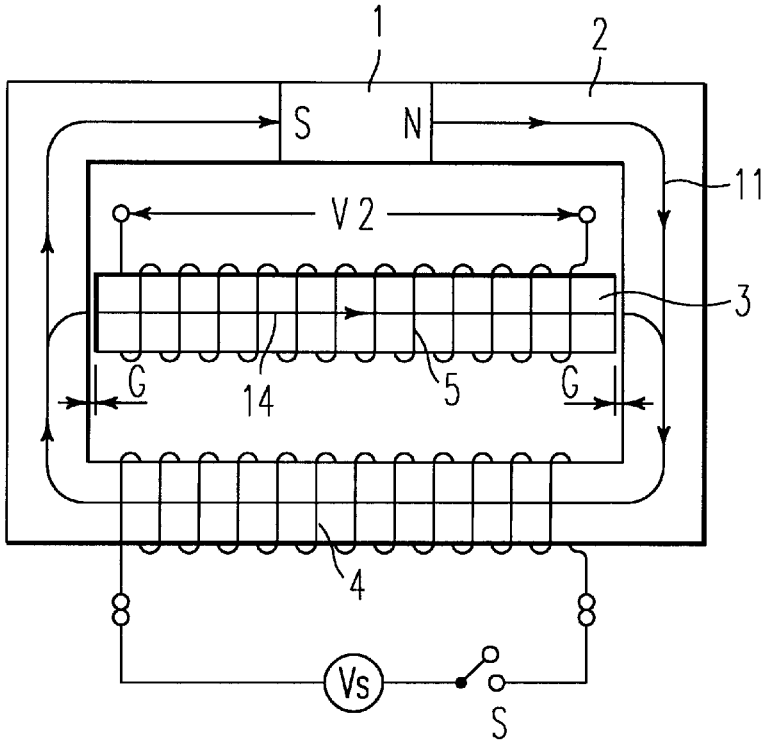
FIG. 3 represents how a flux in the direction opposed to that of a permanent magnet typically disappears from the magnetized coil.
Figure 4:
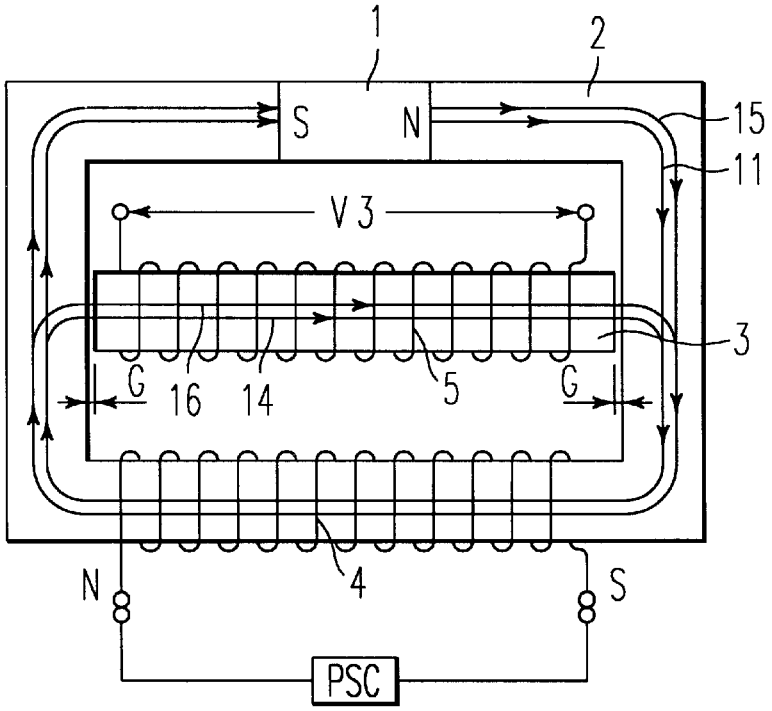
FIG. 4 represents how a flux in the same direction as that of the permanent magnet typically occurs in the magnetized coil.

Referring now to the drawings, wherein like reference numerals designate identical or corresponding parts throughout the several views, and more particularly to FIG. 1 thereof, there is illustrated a basic configuration of the static magnet dynamo with one permanent magnet. FIGS. 2, 3, and 4 describe how the static magnet dynamo represented in FIG. 1 generates power.

As indicated in the figures, the first core 2 formed to couple the permanent magnet 1 and the different poles of the permanent magnet 1 in an annular manner forms a closed magnetic path. This closed magnetic path is then equipped with a second core 3 via a paramagnetic material 10 $\mu$m to 5 mm thick. This results in the formation of an open magnetic path consisting of a permanent magnet 1, part of a first core 2, a paramagnetic material, and a second core 3. The part consisting only of the closed magnetic path of the first core 2 is wound around with a magnetized coil 4. The second core 3 is then wound around with an induction coil 5 designed to generate electromotive force by electromagnetic induction.

Here, the permanent magnet 1 is a magnet with a high residual flux density, a great coercive force, and a large maximum energy product for higher power generation efficiency. Typical materials used here are neodymium iron boride magnet ($Nd_2Fe_{14}B$), samarium cobalt magnet ($Sm_2Co_{17}$), or samarium iron nitride ($Sm_2Fe_{17}N_2$).

The first core 2 and the second core 3 are made of a soft magnetic material having a high permeability, with high initial, maximum, and other permeability levels, high residual flux density and saturation magnetization, and small coercive force, thus making effective use of the flux of the magnetic path for power generation. Examples include Permalloy.based alloys.

Applicable paramagnetic materials are those with a specific permeability comparable to that of a vacuum, such as air, copper, and aluminum. When air is used as a paramagnetic material, that is, when a gap G is secured between the first core 2 and the second core 3, the second core 3 is retained with a solid paramagnetic material. The figures represent embodiments with a gap G, without a solid paramagnetic material designed to retain the second core 3.

Following is a description of how a static magnet dynamo of the above configuration generates power.

First, when no voltage is applied to the magnetized coil 4 of the static magnet dynamo, a first flux 11 is formed in the first core 2 in the direction going from tho N pole to the S pole of the permanent magnet 1. In this state, no flux has been formed in the second core 3 coupled via the gap G.

A voltage can be applied to the magnetized coil 4 in three manners described below.

In the first voltage application, as indicated in FIG. 2, a DC voltage VS is applied to the magnetized coil 4 in the direction that the voltage repels the first flux 11 of the first core 2 generated by the permanent magnet 1, and vice versa, that is, in such a manner that the second flux 12 occurs in the reverse direction of the first flux 11. As a result, the first flux 11 repels the second flux 12 and vice versa, so that the flux more easily leaks from the closed magnetic path. The first flux 11 and the second flux 12, which more easily leak from the closed magnetic path, jump across the gap G and enter the second core 3, so that a third flux 13 is induced in the second core 3. Furthermore, the induction of this third flux 13 changes the flux passing through the induction coil 5, so that electromotive force V1 occurs in the induction coil 5, resulting in power being generated.

Next, removing the DC voltage applied to the magnetized coil 4 prompts the first core 2 to try going back to a state where only the first flux 11 is formed as indicated in FIG. 1. At that time, the second core 3 has a flux in the reverse direction of the third flux 13, that is, the fourth flux 14 indicated in FIG. 3, in order to kill the third flux 13. Then, the induction of the fourth flux 14 changes the flux passing the induction coil 5, so that electromotive force V2 occurs in the induction coil 5, resulting in power being generated.

Power generation in this first voltage application can be realized by a static magnet dynamo involved in this invention, a DC power supply to apply a DC voltage VS to the magnetized coil 4, and a switching circuits that turns on and off the DC power supply. A no-contact switching circuit can be made if a semiconductor switching device, such as a thyristor, is available, The second voltage application is the same as the first voltage application up to the point where the third flux 13 is induced in the second core 3 by applying a DC voltage VS to the magnetized coil 4 so as to generate the second flux 12 in the reverse direction of the first flux 11 and where the third flux 13 is induced to generate electromotive force V1 in the induction coil 5, thus generating power.

Next, changing the polarity of the DC voltage applied to the magnetized coil 4 generates in the first core 2 the first flux 11 caused by the permanent magnet 1, as well as the fifth flux 15 in the same direction as the first flux, caused by the magnetized coil 4. Here, the first flux 11 is given the fifth flux 15, so that the second core 3 is given the fourth flux 14 as indicated in FIG. 4, as well as the sixth flux 16 in the same direction as the fourth flux 14. Furthermore, inducing the fourth flux 14 and the sixth flux 16 changes the flux passing through the induction coil 5, so that an electromotive force V3 larger than the electromotive force V2 is generated in the rotary coil to generate power.

This second voltage application requires a polarity switching circuit PSC that changes the polarity of DO voltage instead of a switching circuit that turns on and off the DC voltage applied to the magnetized coil 4 in the first voltage application. This polarity switching circuit can be made of a semiconductor switching device, similarly to the switching circuit in the first voltage application.

In the third voltage application, AC voltage VS is applied to the magnetized coil 4 instead of applying DC voltage to the magnetized coil 4 in the second voltage application with the polarity changed. The flux generated by applying AC voltage to the magnetized coil 4 becomes an alternating flux that alternates between the second flux 12 in FIG. 2 and the fifth flux 15 in. FIG. 4. Then, the flux induced in the second core 3 is the third flux 13 in FIG. 2 when the second flux 12 is generated, and is the fourth flux 14 trying to kill the sixth flux 16 and the third flux 19 in FIG. 4 when the fifth flux 15 is generated. That is, the flux induced in the second core 3 naturally also becomes an alternating flux.

In power generation of this third voltage application, AC voltage is applied to the magnetized coil 4, which obviates the need for a switching circuits or polarity switching circuit PSC, which was needed in the first and the second voltage application, so that the device gets simplified. Furthermore, the flux induced in the first core 2 and the second core 3 becomes an alternating flux induced by AC voltage, so that the dynamo functions also as a transformer having a gap G between the first core 2 and the second core 3. It is therefore possible to increase electromotive force V generated by electromagnetic induction in the induction coil 5 further.

Next, the power generation efficiency of a static magnet dynamo involved in this invention is described. The static magnet dynamo can be considered as a transformer if its permanent magnet 1 is removed and there is a gap G.

A transformer entails an eddy current loss Wv and hysteresis loss Wh of the core, and a loss Wr due to the electric resistance of the coil. These factors are in a relation formulated below.

$$\text{Total loss } W1=Wv+Wh+Wr \quad (1)$$

Let the input be Win and the output Wo, and the Win becomes equal to the total loss, so that the conversion efficiency of the transformer is $$Eff=Wo/Win=Wo(Wv+Wh+Wr)<1 \quad (2)$$

In reality, in FIG. 1, the closed magnetic path consisting of the first core 2 contains a permanent magnet 1. The flux of this permanent magnet 1 therefore contributes to power generation.

Therefore, in FIG. 1, let the input be Win2 and the output Wo2, then $$Wo2=Wp+\alpha Win2 \quad (3)$$

Where Wp represents power resulting from the flux of the permanent magnet 1 contributing to power generation, and $\alpha$ represents a conversion efficiency obtained when the device is considered as a transformer with a gap G.

Therefore, power generation efficiency is $$Eff = Wo2 / Win2 = (Wp + \alpha\ Win2) / Win2 \quad (4)$$

$$= (Wp / Win2) + \alpha$$

Here, since $\alpha<1$, if Wp/Win2>1, that is, if power obtained resulting from the flux of the permanent magnet 1 contributing to power generation is larger than dynamo power supplied to the magnetized coil 4, power generation efficiency becomes no less than 1, so that the device can display its performance as a dynamo.

Thus, the inventor examined as described below how much the flux of the permanent Magnet 1 contributes to the induction of the third flux 13 in FIG. 2. First, the inventor provided static magnet dynamos of the basic configuration indicated in FIG. 1, one with a permanent magnet 1 and another without a permanent magnet 1. The inventor then compared the power levels needed to induce fluxes of equal flux densities to the second core 3 of each embodiment, that is, the power levels supplied to the magnetized coil 4. As a result, an embodiment with a permanent magnet 1 required only a very low power level to be supplied to the magnetized coil 4. It was observed that the power level required was no more than 1/40 of that of the embodiment without a permanent magnet 1, depending on the test condition.

In a static magnet dynamo involved in this invention, therefore, Win2 can be made sufficiently smaller than Wp, so that the inventor considers it possible to make Wp/Win2 >1.

Embodiment 1

Next, as the first embodiment, a static magnet dynamo system composed of two static magnet dynamos of the basic configuration is described based on FIG. 5.

Figure 5A:
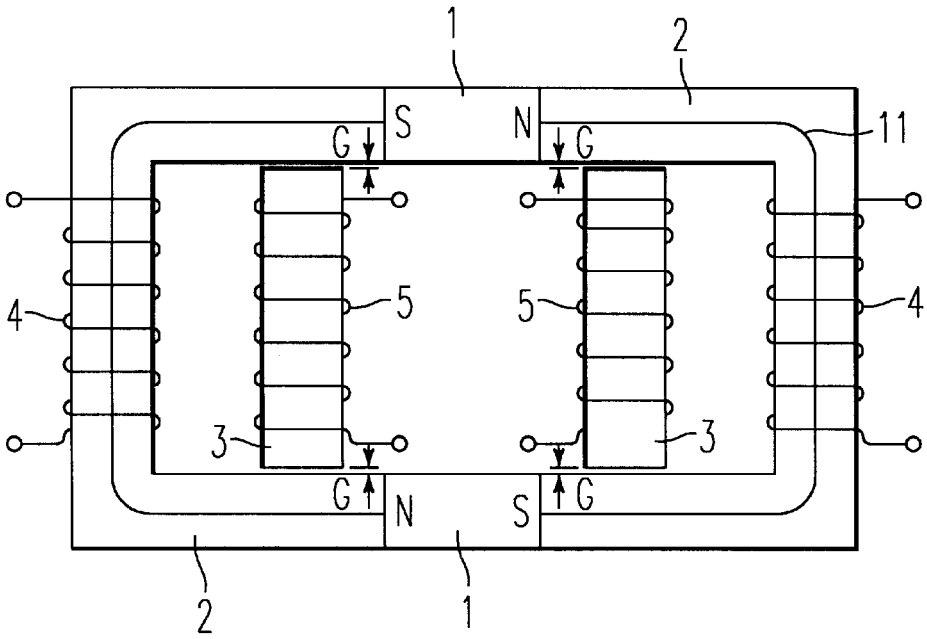
FIG. 5 is a first embodiment of the static magnet dynamo involved in this invention.

In FIG. 5(A), in a static magnet dynamo, a closed magnetic path is made of two permanent magnets 1 and two first cores 2 formed so as to couple the different poles of one permanent magnet 1 with the other permanent magnet 1 in an annular manner. This closed magnetic path is then equipped with a second core 3 via a gap G. This forms an open magnetic path consisting of a permanent magnet 1, part of a first core 2, a paramagnetic material, and a second core 3.

Figure 5B:
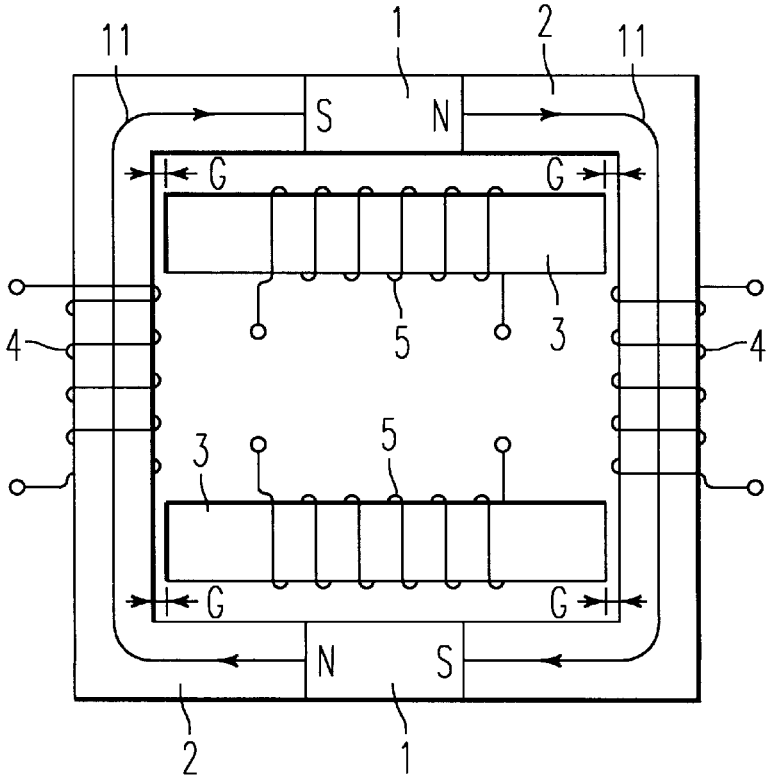

This open magnetic path can be composed in two manners. In one configuration, as indicated in FIG. 5(A), one open magnetic path can be made of two permanent magnets 1 and two second cores 3. In the other configuration, as indicated in FIG. 5(B), one open magnetic path can be made of one permanent magnet 1 and another can be made of one first core 2. The static magnet dynamos in FIG. 5(A) and FIG. 5(B) do not differ substantially in terms of effect results, except that their patterns forming such an open magnetic path differ.

The part forming only a closed magnetic path of each first core 2 is wound around with a magnetized coil 4. Each second core 3 is then wound around with an induction coil 5 that generates electromotive force by electromagnetic induction.

This static magnet dynamo forms a first flux 11 in the first core 2 in the direction going from the N pole to the S pole of the permanent magnet 1, with no voltage applied to the magnetized coil 4. Furthermore, the action of this dynamo applying voltage to the magnetized coil 4 and generating electromotive force in the induction coil 5 by electromagnetic induction to generate power is similar to static magnet dynamos of the basic configuration.

The static magnet dynamo with two permanent magnets 1 as mentioned above has well-balanced magnetic paths. Since the flux of the permanent magnets 1 can be effectively used, this embodiment achieves higher power generation efficiency than static magnet dynamos of the basic configuration.

The first embodiment is a static magnet dynamo system composed of two static magnet dynamos of the basic configuration. Similarly, a static magnet dynamo system can be made as a combination of three or more static magnet dynamos of the basic configuration (FIGS. 1–4). In that case, similarly to the first embodiment, an open magnetic path can be formed in two manners. One configuration is the formation of one open magnetic path by coupling all permanent magnets 1 with a second core 3. The other is the formation of as many open magnetic paths as permanent magnets by coupling the N pole of each permanent magnet 1 to the S pole with a second core 3.

Embodiment 2

Figure 6:
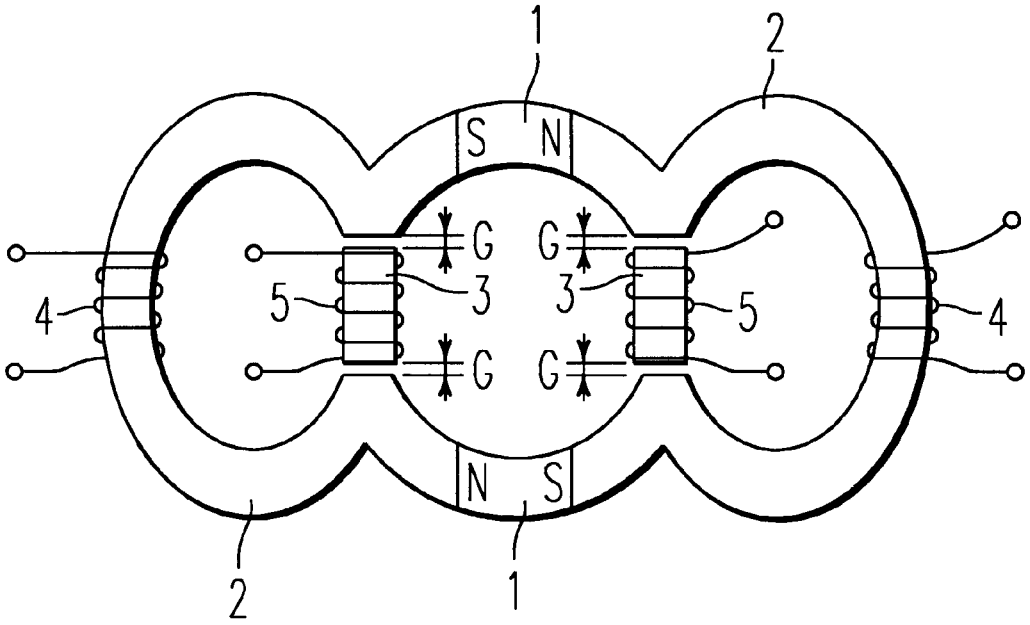
FIG. 6 is a second embodiment of the static magnet dynamo involved in this invention.
Figure 7:
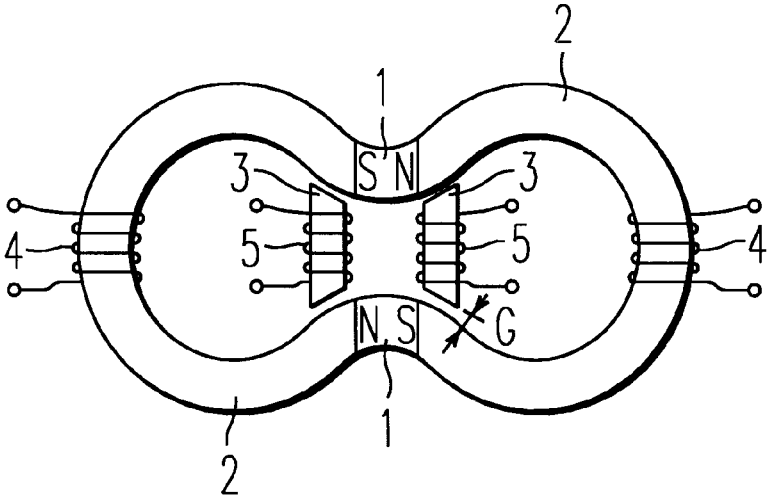
FIG. 7 is a third embodiment of the static magnet dynamo involved in this invention.
Figure 8:
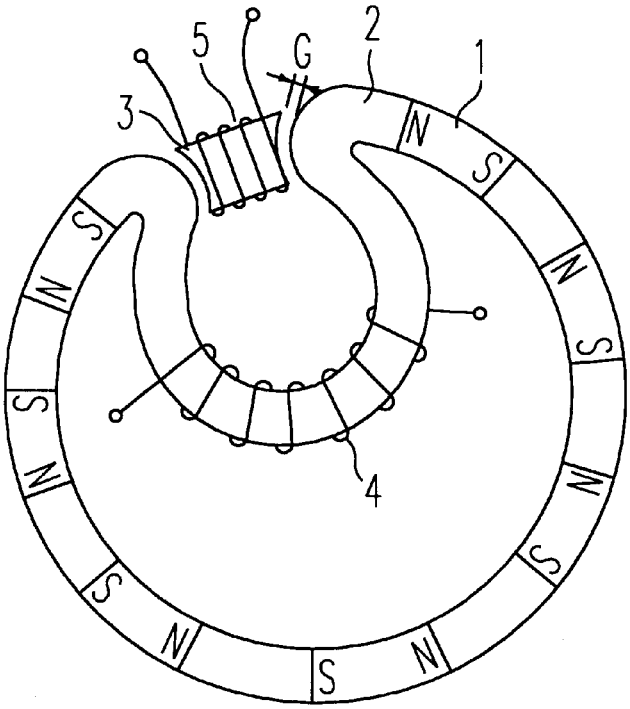
FIG. 8 is a fourth embodiment of the static magnet dynamo involved in this invention.

Next, the second embodiment of the present invention is represented in FIG. 6, the third embodiment in FIG. 7, and the fourth embodiment in FIG. 8. In these embodiments, the action of applying voltage to the magnetized coil 4 and generating electromotive force in the induction coil 5 by electromagnetic induction is similar to that of a static magnet dynamo of the basic configuration (FIGS. 1–4).

The second and the third embodiments represented in FIGS. 6 and 7 have the same basic configuration as the first embodiment, except that the first core 2 in each embodiment is shaped quite differently.

In the second embodiment, the part opposed to the end of the second core 3 sticks out toward the end of the second core 3. Thus, the leakage flux due to the repellence of the first flux 11 and the second flux 12 generated in the first core 2 jumps across the gap G and enters the second core 3 with greater ease.

Embodiment 3

The third embodiment is so designed that the part coupling the second core 3 is that part of the first core 2 which is nearest to the permanent magnet 1 and, to shorten the open magnetic path even further, the two permanent magnets 1 are close to each other. Since a flux tends to form a closed magnetic path with the shortest distance, the leakage flux due to the repellence of the first flux 11 and the second flux 12 generated in the first core 2 jumps across the gap G and enters the second core 3 with greater ease.

Embodiment 4

The fourth embodiment indicated in FIG. 8, as opposed to a static magnet dynamo of the basic configuration, consists of a first loop where permanent magnets 1 with multiple closed magnetic paths are arranged circularly with the fluxes oriented in the same direction, and of a second loop which is wound around with a magnetized coil 4 and installed inside the first loop. Furthermore, the parts with their first cores 2 coupling the first loop to the second one stick out toward each other across a specified gap. The parts where this first core 2 stick out are coupled together with a second core 3 via a gap G to form an open magnetic path. This reinforces the flux of the permanent magnets 1 and makes it easier for the leakage flux due to the repellence of the first flux 11 and the second flux 12 generated in the first core 2 to jump across the gap G and enter the second core 3.

Embodiment 5

Figure 9:
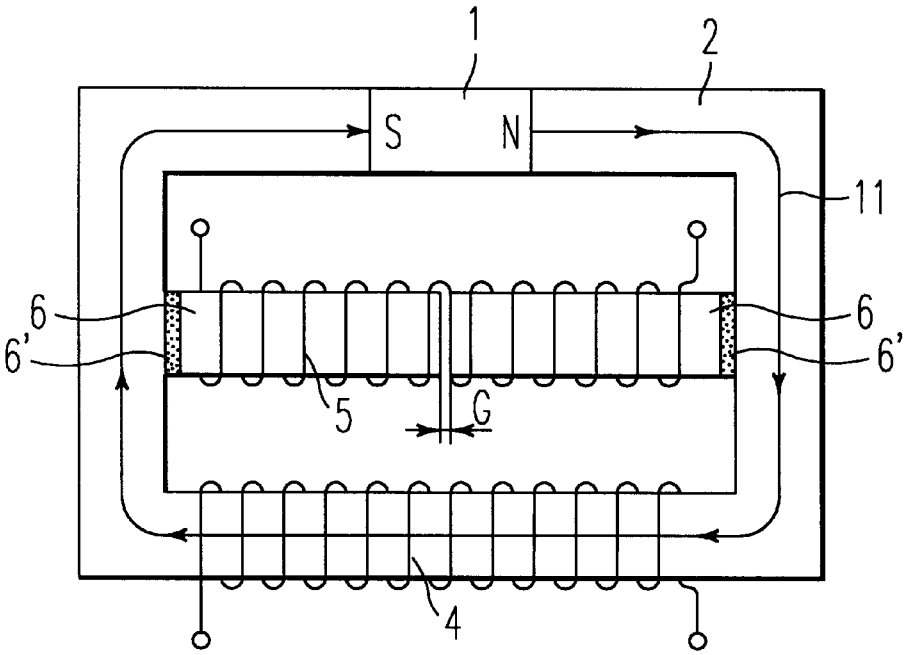
FIG. 9 is a fifth embodiment with an open magnetic path.

The configuration of a static magnet dynamo involved in this invention has so far been described in terms of embodiments where an open magnetic path is connected to the first core 2 at both ends of the second core 3 via a paramagnetic material. However, this invention is not limited to these embodiments. That is, as indicated in FIG. 9, the open magnetic path may be embodied by extending any two parts of the first core 2 in the direction that they approach each other, thus defining them as core extensions 6, and coupling these core extensions 6 via a paramagnetic material 6. This embodiment can be applied to all embodiments mentioned above.

Embodiment 6

Figure 10:
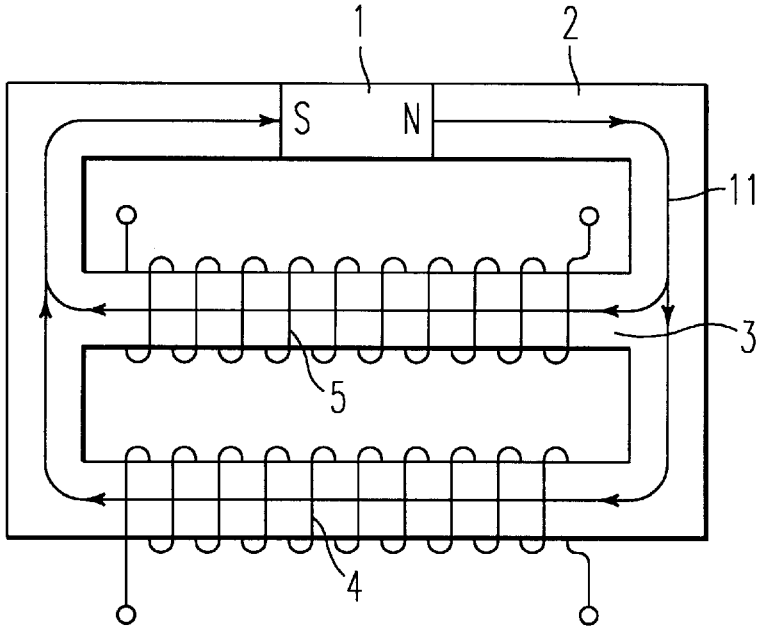
FIG. 10 is a basic configuration of a static magnet dynamo with a closed magnetic path involved in this invention.

As indicated in FIG. 10, a closed magnetic path consists of a permanent magnet 1 and a first core 2 formed so as to couple the different poles of the said permanent magnet 1 in an annular manner. This closed magnetic path is then equipped with a second core 3 so that it comes magnetically in parallel with the permanent magnet 1, so that a bypass closed magnetic path is composed of a permanent magnet 1, part of a first core 2, and a second core 3.

The part consisting only of the closed magnetic path of the first core 2 is wounded around with a magnetized coil 4. The second core 3 is then wounded around with an induction coil 5 designed to generate electromotive force by electromagnetic induction.

The action of a static magnet dynamo of the above configuration generating power is described below.

First, when no voltage is applied to the magnetized coil 4 of a static magnet dynamo, the first core 2 forms a first flux 11 in the direction going from the N pole to the S pole of the permanent magnet 1. In this state, a flux similar to that of the first core 2 is generated in the second core 3 as well.

Embodiment 7

Figure 11:
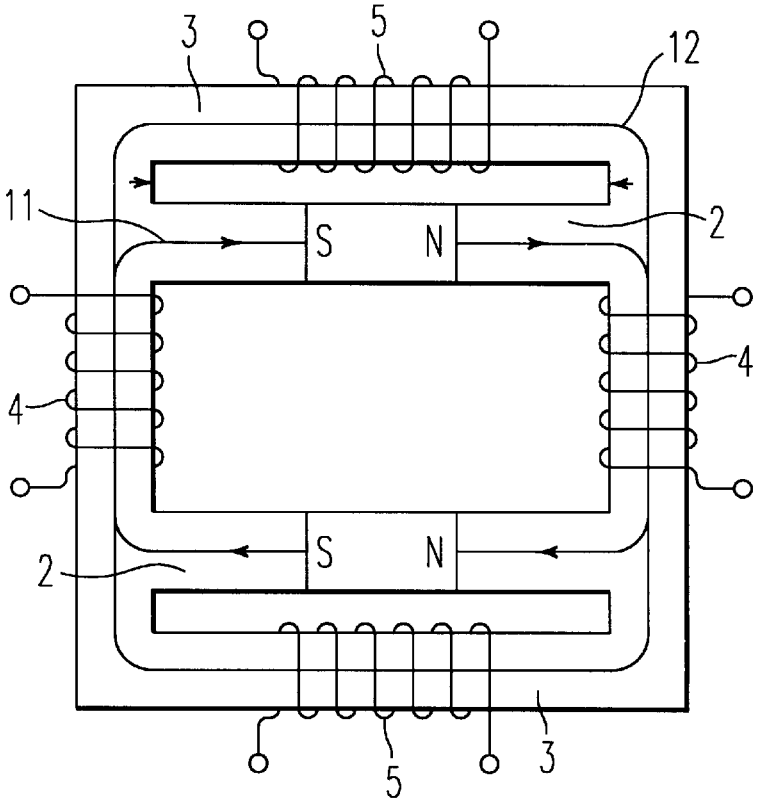
FIG. 11 is a first embodiment of the static magnet dynamo with a closed magnetic path involved in this invention.

The seventh embodiment is described below based on FIG. 11, in terms of a static magnet dynamo system composed of two static magnet dynamos of the basic configuration and with the relative position of the permanent magnets changed.

In a static magnet dynamo, a closed magnetic path is composed of two permanent magnets 1 and two first cores 2 so designed as to couple the different poles of one of the permanent magnets 1 with the other permanent magnet 1 in an annular manner. This closed magnetic path is then equipped with a second core 3. This results in the formation of a bypass closed magnetic path consisting of a permanent magnet 1, part of a first core 2, a paramagnetic material, and a second core 3.

The parts where a closed magnetic path of each first core 2 alone is formed are wound around with a magnetized coil 4. Each second core 3 is then wound around with an induction coil 5 designed to generate electromotive force by electromagnetic induction.

In this static magnet dynamo, where no voltage is applied to the magnetized coil 4, a first flux 11 is formed in the first core 2 in the direction going from the N pole to the S pole of the permanent magnet 1. The action of applying voltage to the magnetized coil 4 and generating electromotive force in the induction coil 5 by electromagnetic induction to generate power is similar to that of a static magnet dynamo of the basic configuration.

In the aforementioned static magnet dynamo incorporating two permanent magnets 1, magnetic paths are arranged in a well-balanced manner. This makes it possible to make effective use of the flux of the permanent magnets 1, so that power generation efficiency is higher than that of a static magnet dynamo of the basic configuration.

This invention has so far been described somewhat in detail in terms of the most favorable embodiments. Since it is clear that a wide variety of embodiments can be realized without opposing the philosophy and scope of this invention, this invention will not be limited to any particular embodiment, except for the limitations described in the attached claim.

What is claimed as new and desired to be secured by Letters Patent of the United States is:

1. A static magnet dynamo comprising:

at least one permanent magnet having different poles;

a first core comprising a soft magnetic material and which couples the different poles of the permanent magnet to form a closed magnetic path therein;

a second core comprising a soft magnetic material which couples to the closed magnetic path via a paramagnetic material to form an open magnetic path;

a magnetized coil wound around a portion of the first core where the closed magnetic path is formed; and an induction coil wound around a portion of the second core;

wherein a direction of a flux of the closed magnetic path is changed by applying an alternating voltage to the magnetized coil, generating an electromotive force in the induction coil by electromagnetic induction due changes in a flux of the open magnetic path induced by the change in direction of the flux of the closed magnetic path.

2. A static magnet dynamo comprising:

at least one permanent magnet having different poles;

a first core comprising a soft magnetic material and which couples the different poles of the permanent magnet to form a closed magnetic path therein;

a core extension of the first core comprising a soft magnetic material and connected between the first core via a paramagnetic material and which couples to the closed magnetic path to form an open magnetic path;

a magnetized coil wound around a portion of the first core where the closed magnetic path is formed; and an induction coil wound around a portion of the core extension;

wherein a direction of a flux of the closed magnetic path is changed by applying an alternating voltage to the magnetized coil, generating an electromotive force in the induction coil by electromagnetic induction due changes in a flux of the open magnetic path induced by the change in direction of the flux of the closed magnetic path.

3. A static magnet dynamo comprising:

at least one permanent magnet having different poles;

a first core comprising a soft magnetic material and which couples the different poles of the permanent magnet to form a closed magnetic path therein;

a second core comprising a soft magnetic material and which forms a bypass closed magnetic path which is coupled with the closed magnetic path in a same direction of a flux thereof;

a magnetized coil wound around a portion of the first core where the closed magnetic path is formed; and an induction coil wound around a portion of the second core;

wherein a direction of the flux of the closed magnetic path is changed by applying an alternating voltage to the magnetized coil, generating an electromotive force in the induction coil by electromagnetic induction due changes in a flux of the bypass magnetic path induced by the change in direction of the flux of the closed magnetic path.

* * * * *